US012108865B2

(12) United States Patent
Dicu

(10) Patent No.: US 12,108,865 B2
(45) Date of Patent: Oct. 8, 2024

(54) BACKPACK COMPRISING AN OUTER ENCLOSURE SEPARATE FROM THE MAIN POCKET

(71) Applicant: BLUE ICE EUROPE, Les Houches (FR)

(72) Inventor: Sorin Dicu, Sallanches (FR)

(73) Assignee: BLUE ICE EUROPE, Les Houches (FR)

( * ) Notice: Subject to any disclaimer, the term of this patent is extended or adjusted under 35 U.S.C. 154(b) by 129 days.

(21) Appl. No.: 17/998,848

(22) PCT Filed: May 25, 2021

(86) PCT No.: PCT/FR2021/050945
§ 371 (c)(1),
(2) Date: Nov. 15, 2022

(87) PCT Pub. No.: WO2021/240108
PCT Pub. Date: Dec. 2, 2021

(65) Prior Publication Data

US 2023/0189967 A1 Jun. 22, 2023

(30) Foreign Application Priority Data

May 28, 2020 (FR) ..... 2005629

(51) Int. Cl.
*A45F 3/04* (2006.01)

(52) U.S. Cl.
CPC ..... *A45F 3/04* (2013.01); *A45F 2003/045* (2013.01)

(58) Field of Classification Search
CPC ..... A45F 3/04
(Continued)

(56) References Cited

U.S. PATENT DOCUMENTS 5,154,332 A * 10/1992 Williams ..... A45F 3/04 224/153
5,634,576 A * 6/1997 Arbel ..... A45C 5/14 224/652

(Continued)

FOREIGN PATENT DOCUMENTS

DE 102018100143 A1 7/2019
JP 2006141567 A 6/2006

(Continued)

OTHER PUBLICATIONS

International Search Report issued Sep. 22, 2021 re: Application No. PCT/FR2021/050945, pp. 1-2, citing: WO 2019126918 A1, WO 2011053961 A2 and JP 2006141567 A.

*Primary Examiner* — Justin M Larson
(74) *Attorney, Agent, or Firm* — CANTOR COLBURN LLP

(57) ABSTRACT

A backpack including at least one shoulder strap intended for carrying the backpack by a user includes a main pocket, connected to the at least one shoulder strap and a reinforcement, the main pocket having an inner surface internally delimiting a first compartment.

The backpack also includes an outer enclosure constituting a piece separate from the main pocket, and an inner surface. A fastening system for the backpack is configured so that the backpack may occupy a separation configuration in which the outer enclosure is completely separated from the main pocket and a fastening configuration in which the reinforcement is secured to all or part of an outline of the outer casing. The inner surface of the outer enclosure and the outer surface of the main pocket internally delimit therebetween, when the backpack is in the fastening configuration, a second compartment separate from the first compartment.

10 Claims, 2 Drawing Sheets

(58) Field of Classification Search
USPC ..... 224/581–583
See application file for complete search history.

(56) References Cited

U.S. PATENT DOCUMENTS

| | | | | |
|---|---|---|---|---|
| 6,216,926 | B1 * | 4/2001 | Pratt | A45F 3/04 224/655 |
| 7,617,956 | B1 * | 11/2009 | Sabbah | A45C 5/143 280/37 |
| 8,123,581 | B2 * | 2/2012 | Aschauer | A62B 99/00 116/210 |
| 8,475,045 | B2 * | 7/2013 | Meyer | A45C 13/002 150/112 |
| 8,919,628 | B2 * | 12/2014 | Jamlang | A45F 3/10 224/583 |
| 9,913,515 | B2 * | 3/2018 | Lin | A45F 3/04 |
| 10,188,196 | B2 * | 1/2019 | Thibadeau | A45F 3/04 |
| 11,607,029 | B2 * | 3/2023 | Logan | A45C 5/141 |
| 11,690,436 | B2 * | 7/2023 | Jusic | A45F 3/04 224/655 |
| 11,805,885 | B2 * | 11/2023 | Haines | A45F 3/04 |
| 2012/0121210 | A1 * | 5/2012 | Meyer | A45C 13/002 224/257 |
| 2015/0144666 | A1 * | 5/2015 | Rana | A45F 3/04 224/153 |
| 2024/0057748 | A1 * | 2/2024 | Haines | A45C 13/002 |
| 2024/0074556 | A1 * | 3/2024 | Logan | A45C 7/0045 |

FOREIGN PATENT DOCUMENTS

| | | | |
|---|---|---|---|
| WO | 2011053961 | A1 | 5/2011 |
| WO | 2019126918 | A1 | 7/2019 |

* cited by examiner

BACKPACK COMPRISING AN OUTER ENCLOSURE SEPARATE FROM THE MAIN POCKET

TECHNICAL FIELD

The present disclosure concerns a backpack comprising at least one shoulder strap intended for carrying the backpack by a user, a main pocket formed from a flexible material, and an outer enclosure formed from a flexible material.

BACKGROUND

Regardless of the field of application in which they are used, backpacks are generally configured to carry loads inserted into compartments of the backpack and carried thereby on the back of the user of the backpack.

However, depending on the volume of all the loads carried, it may be advantageous to suggest a backpack with a modular volume capacity.

It is known from the prior art, the document DE102018100143A1 which discloses a backpack system, in particular for use on two wheels. The backpack comprises an outer enclosure on which additional enclosures may be fastened so as to enlarge the capacity of the backpack if necessary.

This solution is satisfactory in that it makes it possible to suggest a backpack with a modular volume capacity according to the needs of the user.

However, this type of system has the drawback of being fastened to the outer face of the outer enclosure, which contributes to unbalancing the balance of the loads in the backpack. This is particularly inconvenient when the carried loads are heavy, and it may cause back or lumbar pain for the carrier of the backpack. Moreover, the existing solutions do not suggest additional enclosures to increase the volume with a capacity substantially greater than or equal to that of the main pocket.

SUMMARY

The present disclosure aims at providing a solution which responds to all or part of the problems cited above.

This aim may be achieved through the implementation of a backpack comprising at least one shoulder strap intended for carrying the backpack by a user, the backpack comprising:

- a main pocket formed from a flexible material, connected to said at least one shoulder strap and comprising a reinforcement, said main pocket comprising an inner surface internally delimiting a first compartment located on the side opposite said at least one shoulder strap with respect to the reinforcement;
- an outer enclosure formed from a flexible material and constituting a piece separate from the main pocket, the outer enclosure comprising an inner surface;
- a fastening system configured so that the backpack may occupy a separation configuration in which the outer enclosure is completely separated from the main pocket and a fastening configuration in which the reinforcement is secured to all or part of an outline of the outer enclosure, the inner surface of the outer enclosure and the outer surface of the main pocket internally delimiting therebetween, when the backpack is in the fastening configuration, a second compartment separate from the first compartment, the second compartment being disposed on the side opposite the reinforcement with respect to the first compartment.

The arrangements described above make it possible, according to the needs of the user, to modulate the capacity of the backpack. Advantageously, the fastening system is positioned at the reinforcement of the main pocket. Thus, this makes it possible to directly transfer a mass contained in the second compartment to the reinforcement, itself supported by the at least one shoulder strap, which contributes to improving the lateral support of the whole backpack, while increasing the volume capacity of the backpack. The backpack may further have one or several of the following features, considered alone or in combination.

According to one embodiment, the first compartment is attached by its outline to the periphery of the reinforcement.

According to one embodiment, the main pocket delimits the first compartment so as to constitute a backpack, when the backpack occupies the separation configuration. It is therefore clearly understood that the outer enclosure makes it possible to define a second auxiliary compartment in the backpack, and that the first compartment is an essential compartment of the backpack. In other words, it is possible to constitute a backpack with the main pocket when the outer enclosure is detached from the reinforcement.

According to one embodiment, the second compartment has a volume substantially greater than or equal to the volume of the first compartment.

According to one embodiment, the volume of the first compartment is greater than or equal to 20 litres, and in particular greater than or equal to 25 litres, and more particularly greater than or equal to 50 litres. For example, the volume of the first compartment may be comprised between 25 litres and 50 litres.

By "substantially equal", it should be understood that the ratio between the volume of the first compartment and the volume of the second compartment is between 0.5 and 1.

According to one embodiment, the inner surface of the outer enclosure and the reinforcement delimit internally therebetween, in the fastening configuration, a total volume in which the first compartment is completely contained.

According to one embodiment, the volume defined by the inner surface of the outer casing contains the volume of the first compartment. In other words, the outer enclosure defines a volume in which the first compartment and the second compartment are entirely comprised.

The main pocket and the outer enclosure being made of a flexible material, the ratio between the volume of the first compartment and the volume of the second compartment may vary, and be adapted according to the load contained in each compartment. For example, the first compartment may be entirely empty and the second compartment entirely full. In this way, the user of the backpack may choose to distribute the load as desired between the first compartment and the second compartment.

According to one embodiment, the reinforcement is disposed at an outer surface of the main pocket intended to face the back of the user. For example, the reinforcement may be integrated, attached, or secured to the constituent material of the main pocket at its outer surface.

According to one embodiment, the reinforcement is disposed at an inner surface of the main pocket, for example inside the first compartment.

According to one embodiment, the reinforcement is made of at least one metal or an alloy of said at least one metal.

In this way, the reinforcement may stiffen the structure of the backpack, in particular when the first compartment and/or the second compartment contain a heavy load.

Alternatively or jointly, the reinforcement may be made of a plastic material.

According to one embodiment, the fastening system comprises a zip closure.

According to one embodiment, the fastening system comprises buckles or fasteners associated with shoulder straps or strips.

According to one embodiment, the fastening system comprises at least one adhesive element with reversible attachment.

According to one embodiment, the fastening system comprises at least one dome fastener.

According to one embodiment, the backpack comprises a belt and two shoulder straps.

According to one embodiment, the backpack comprises a chest strap.

According to one embodiment, the group composed of one or several of the elements from among the reinforcement, the belt, the chest strap, an outer surface of the main pocket, the shoulder straps, constitutes the carrying system of the backpack. In this manner, all or part of the load comprised in the first compartment and/or in the second compartment, is distributed over the user of the backpack at the level of the carrying system of the backpack, that is to say at the at the level of the reinforcement, and/or at the level of the belt, and/or at the level of the chest strap, and/or at the level of the outer surface of the main pocket, and/or at the level of the shoulder straps of the backpack. In other words, the load contained in the second compartment is distributed directly to the carrying system.

According to one embodiment, the reinforcement is secured to the carrying system, said carrying system comprising one or several of the elements from among the belt, the chest strap, an outer surface of the main pocket, and the shoulder straps.

According to one embodiment, the carrying system is secured to the main pocket.

According to one embodiment, the carrying system and the main pocket are formed integrally. In other words, the carrying system is inseparable from the main pocket.

The arrangements previously described make it possible to obtain two containments, one corresponding to the main pocket and the other corresponding to the outer enclosure which is folded on itself. It is possible to provide that in this configuration of the outer enclosure, the latter delimits an unclosed volume, that is to say open so as to communicate with the outside.

According to one embodiment, all or part of the fastening system comprised on the outer enclosure is configured to allow the enclosure to be closed on itself, in particular in the separation configuration. Alternatively, the outer enclosure may include a closure system separate from the fastening system and configured to allow the outer enclosure to be closed on itself in the separation configuration. In this manner, it is possible to place the outer enclosure in a compacted configuration, for example to store it. Alternatively, when the outer enclosure is closed on itself, it can be used as a separate bag by forming a bag on its own.

According to one embodiment, the outer enclosure comprises an opening system configured to provide reversibly, in the fastening configuration, a passage through the outer enclosure giving access to the second compartment from outside the backpack.

According to one embodiment, the outer enclosure may comprise at least one pocket. Thus, said pockets may constitute additional storage space inside the backpack when the outer enclosure is in the fastening configuration.

The arrangements previously described allow the user of the backpack to insert objects into the second compartment, in particular when the outer enclosure is fastened to the reinforcement.

BRIEF DESCRIPTION OF THE DRAWINGS

Other aspects, objects, advantages and features of the disclosure will appear better upon reading the following detailed description of preferred embodiments thereof, given by way of non-limiting example, and made with reference to the appended drawings on which.

DETAILED DESCRIPTION OF THE DRAWINGS

In the figures and in the remainder of the description, the same references represent identical or similar elements. In addition, the various elements are not shown to scale so as to favour the clarity of the figures. Furthermore, the various embodiments and variants are not mutually exclusive and may be combined with one another.

As illustrated in FIGS. 1 to 4, the disclosure concerns a backpack 1 comprising at least one shoulder strap 3 intended for carrying the backpack 1 by a user.

Figure 1:
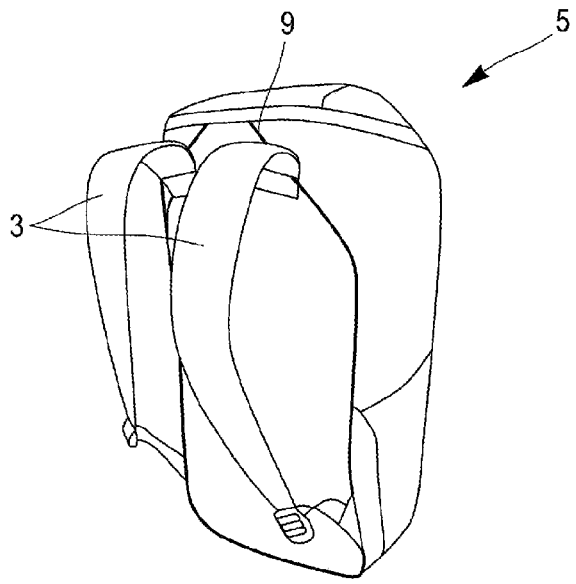
FIG. 1 is a schematic perspective view of the main pocket according to an embodiment of the disclosure.
Figure 3:
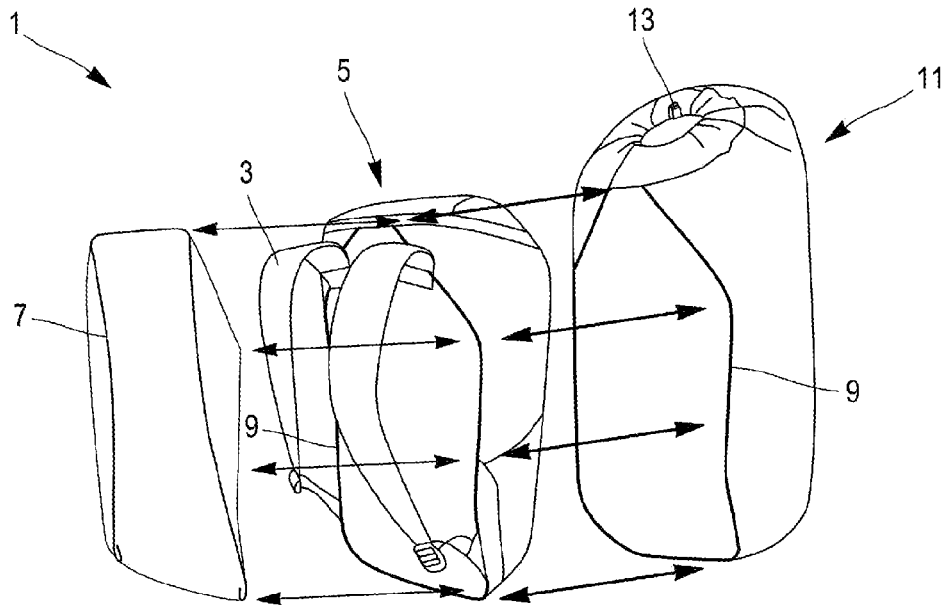
FIG. 3 is a schematic perspective view of the main pocket and the outer enclosure in the separation configuration according to an embodiment of the disclosure.
Figure 4:
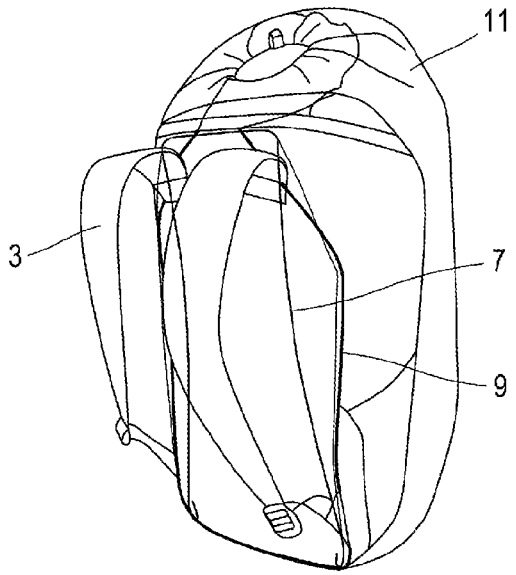
FIG. 4 is a schematic perspective view of the main pocket and the outer enclosure in the fastening configuration according to an embodiment of the disclosure.

FIGS. 1, 3 and 4 illustrate in particular an embodiment in which the backpack 1 comprises two shoulder straps 3.

According to another variant not represented, the backpack 1 may also include a belt.

The backpack 1 comprises in particular a main pocket 5, an outer enclosure 11 and a fastening system 9. The shoulder straps 3, and/or the belt may constitute a carrying system secured to the main pocket 5. For example, the carrying system and the main pocket 5 are integrally formed so that the carrying system is inseparable from the main pocket 5.

The main pocket 5 is formed from a flexible material, is connected to said at least one shoulder strap 3 and comprises a reinforcement 7.

In general, the reinforcement 7 is disposed at an outer surface of the main pocket 5 intended to face the back of the user. Alternatively, the reinforcement 7 may be disposed at an inner surface of the main pocket 5.

For example, the reinforcement 7 may be integrated, attached, or secured to the constituent material the main pocket at its outer surface. According to the example represented in FIGS. 1, 3 and 4, the reinforcement 7, the outer surface of the main pocket, and the shoulder straps 3, constitute a carrying system of the backpack 1.

The reinforcement 7 may in particular be made of at least one metal or an alloy of said at least one metal. Alternatively or jointly, the reinforcement 7 may be made of a plastic material. In this manner, the reinforcement 7 may stiffen the structure of the backpack 1, especially when the backpack 1 contains a heavy load The main pocket 5, detailed in FIG. 1, comprises an inner surface internally delimiting a first compartment located on the side opposite said at least one shoulder strap 3 with respect to the reinforcement 7.

For example, the first compartment may be attached by its outline to the periphery of the reinforcement 7.

Figure 2:
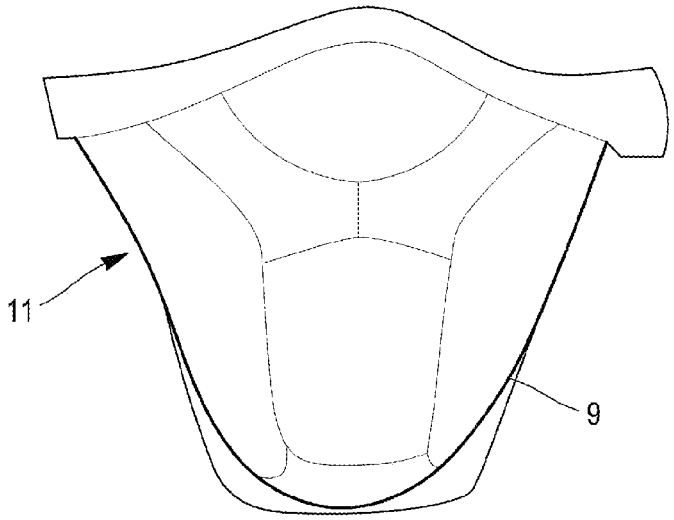
FIG. 2 is a schematic view of the outer enclosure according to an embodiment of the disclosure.

The outer enclosure 11; illustrated in FIG. 2, is formed from a flexible material and constitutes a separate piece of the main pocket 5. The outer enclosure 11 comprises an inner surface.

Finally, the fastening system 9 is configured so that the backpack 1 may occupy a separation configuration in which the outer enclosure 11 is completely separated from the main pocket 5 and a fastening configuration in which the reinforcement 7 is secured to all or part of an outline of the outer enclosure 11.

According to one embodiment, the outer enclosure 11 is configured to fold back on itself, in particular in the separation configuration.

In this manner, it is possible to place the outer enclosure 11 in a compacted configuration, for example to store it.

It is therefore clearly understood that the main pocket 5 delimits the first compartment so as to constitute the backpack 1, in particular when it occupies the separation configuration. The outer enclosure 11 therefore makes it possible to define a second auxiliary compartment to the backpack 1. The first compartment therefore constitutes an essential compartment of the backpack 1. In other words, it is possible to constitute a backpack 1 with the main pocket 5 when the outer enclosure 11 is detached from the reinforcement 7.

Alternatively, when the outer enclosure 11 is closed on itself, it may be used as a separate bag by forming a bag on its own. Advantageously, the inner surface of the outer enclosure 11 and the reinforcement 7 may internally delimit therebetween, in the fastening configuration, a total volume in which the first compartment is entirely contained.

According to a first non-limiting variant, the fastening system 9 comprises a zip closure.

According to a second non-limiting variant, the fastening system 9 comprises at least one adhesive element with reversible attachment.

According to a third non-limiting variant, the fastening system 9 comprises at least one dome fastener.

According to a fourth non-limiting variant, the fastening system 9 comprises buckles or fasteners associated with shoulder straps or strips. The inner surface of the outer enclosure 11 and the outer surface of the main pocket 5 internally delimit therebetween, when the backpack 1 is in the fastening configuration, a second compartment separate from the first compartment, the second compartment being disposed on the side opposite the reinforcement 7 with respect to the first compartment.

According to one embodiment, the second compartment has a volume substantially greater than or equal to the volume of the first compartment.

By "substantially equal", it should be understood that the ratio between the volume of the first compartment and the volume of the second compartment is between 0.5 and 1.

According to one embodiment, the volume of the first compartment is greater than or equal to 20 litres, and in particular greater than or equal to 25 litres, and more particularly greater than or equal to 50 litres. For example, the volume of the first compartment can be comprised between 25 litres and 50 litres.

According to a variant illustrated in FIGS. 3 and 4, the outer enclosure 11 comprises an opening system 13 configured to provide reversibly, in the fastening configuration, a passage through the outer enclosure 11 giving access to the second compartment from outside the backpack 1.

According to one embodiment, the outer enclosure 11 may comprise at least one pocket. Thus, said pockets may constitute additional storage inside the backpack 1 when the outer enclosure 11 is in the fastening configuration.

The arrangements previously described make it possible, according to the needs of the user, to modulate the capacity of the backpack 1.

Furthermore, and advantageously, the fastening system 9 may be positioned at the level of the reinforcement 7 of the main pocket 5. Thus, this makes it possible to directly transfer a mass contained in the second compartment to the reinforcement 7, which is supported by at least one shoulder strap 3, which contributes to improving the lateral support of the whole backpack 1, while increasing the volume capacity of the backpack 1.

In this manner, if a load is comprised in the first compartment and/or in the second compartment, it is distributed over the user of the backpack 1 at the level of the carrying system of the backpack 1, i.e. both at the level of the shoulder straps 3, of the outer surface of the main pocket, and of the reinforcement 7 of the backpack 1, but also at the level of a belt, or a chest strap if the backpack 1 is provided therewith.

The main pocket 5 and the outer enclosure 11 being made of a flexible material, the ratio between the volume of the first compartment and the volume of the second compartment may vary and in particular be adapted according to the load contained in each compartment. For example, the first compartment may be completely empty and the second compartment completely full. In this manner, the user of the backpack 1 can choose to distribute the load as desired between the first compartment and the second compartment.

In addition, the arrangements previously described make it possible to obtain two separate and separable, one corresponding to the main pocket 5 and the other corresponding to the outer enclosure 11 folded on itself.

It is possible to provide that in this configuration of the outer casing 11, the latter delimits an unclosed volume, that is to say open so as to communicate with the outside. Finally, when the outer enclosure 11 comprises an opening system 13, it is possible for the user of the backpack 1 to insert objects into the second compartment, in particular when the outer enclosure 11 is fastened to the reinforcement 7.

The invention claimed is:

1. A backpack comprising at least one shoulder strap intended for carrying the backpack by a user, the backpack comprising:

a main pocket formed from a flexible material, connected to said at least one shoulder strap and comprising a reinforcement, said main pocket comprising an inner surface internally delimiting a first compartment located on the side opposite said at least one shoulder strap with respect to the reinforcement;

an outer enclosure formed from a flexible material and constituting a piece separate from the main pocket, the outer enclosure comprising an inner surface; and a fastening system configured such that the backpack may occupy a separation configuration in which the outer enclosure is completely separated from the main pocket and a fastening configuration in which the reinforcement is secured to all or part of an outline of the outer enclosure, the inner surface of the outer enclosure and the outer surface of the main pocket internally delimiting therebetween, when the backpack is in the fastening configuration, a second compartment separate from the first compartment, the second compartment being arranged on the side opposite the reinforcement with respect to the first compartment; wherein the outer enclosure comprises an opening system configured to provide reversibly, in the fastening configuration, a passage through the outer enclosure giving access to the second compartment from outside the backpack.

2. The backpack according to claim 1, wherein the second compartment has a volume substantially greater than or equal to the volume of the first compartment.

3. The backpack according to claim 1, wherein the inner surface of the outer enclosure and the reinforcement internally delimit therebetween, in the fastening configuration, a total volume in which the first compartment is entirely contained.

4. The backpack according to claim 1, wherein the reinforcement is disposed at an outer surface of the main pocket intended to face the back of the user.

5. The backpack according to claim 1, wherein the reinforcement is made of at least one metal or an alloy of said at least one metal.

6. The backpack according to claim 1, wherein the fastening system comprises a zip closure.

7. The backpack according to claim 1, wherein the fastening system comprises at least one adhesive element with reversible attachment.

8. The backpack according to claim 1, wherein the fastening system comprises at least one dome fastener.

9. The backpack according to claim 1, comprising a belt and two shoulder straps.

10. The backpack according to claim 1, wherein the outer enclosure is configured to fold back on the outer enclosure.

* * * * *